US005699478A

United States Patent [19]

Nahumi

[11] Patent Number: 5,699,478

[45] Date of Patent: Dec. 16, 1997

[54] FRAME ERASURE COMPENSATION TECHNIQUE

[75] Inventor: Dror Nahumi, Ocean, N.J.

[73] Assignee: Lucent Technologies Inc., Murray Hill, N.J.

[21] Appl. No.: 401,840

[22] Filed: Mar. 10, 1995

[51] Int. Cl.[6] ..... G10L 3/02; G10L 9/00

[52] U.S. Cl. ..... 395/2.35; 395/2.37

[58] Field of Search ..... 395/2.35, 2.36, 395/2.37, 2.77, 2.74, 2.16, 2.14, 2.17, 2.23, 2.92, 2.95; 371/278, 41

[56] References Cited

U.S. PATENT DOCUMENTS

| | | | |
|---|---|---|---|
| 4,703,505 | 10/1987 | Seiler et al. | 381/51 |
| 5,097,507 | 3/1992 | Zinser et al. | 381/31 |
| 5,305,332 | 4/1994 | Ozawa | 381/46 |
| 5,353,373 | 10/1994 | Drogo de Iacovo et al. | 395/2.32 |
| 5,414,796 | 5/1995 | Jacobs et al. | 395/2.3 |
| 5,450,449 | 9/1995 | Kroon | 395/2.28 |

OTHER PUBLICATIONS

Wasem et al., "The Effect of Waveform Substitution on the Quality of PCM Packet Communications," IEEE Transactions on Acoustics Speech and Signal Processing, vol. 36, No. 3, Mar. 1988 pp. 342–348.

Barron et al., "Speech Encoding and Reconstruction for Packet based Networks," IEE COLLOQ. Sep. 11, 1992. Issue 199. p. 1–4.

Husain et al., "Reconstruction of Missing Packets For CELP–Based coders".

Watkins et al ., "Improving 16 KB/S G.728 LD–CELP Speech coder for frame erasure channels." ICASSP' 95. vol. 1.pp. 241–244.

Schacham et al., "Packet Recovery in High Speed Networks using Coding and Buffer Management." INFOCOM '90. pp.124–131.

Barron et al ., "Packet–based embedded encoding for transmission of low–bit–rate–encoded speech in packet networks." IEEE Proceedings. Part I: Communication, Speech and Vision, vol. 139, No. 5, Oct. 1992, pp.482–487.

*Primary Examiner*—Allen R. MacDonald
*Assistant Examiner*—Patrick N. Edward
*Attorney, Agent, or Firm*—Steven R. Bartholomew

[57] ABSTRACT

In a speech coding system which encodes speech parameters into a plurality of frames, each frame having a predetermined number of bits, a predefined number of bits per frame are employed to transmit a speech parameter delta. The speech parameter delta specifies the amount by which the value of a given parameter has changed from a previous frame to the present frame. According to a preferred embodiment disclosed herein, a speech parameter delta representing change in pitch delay from the present frame to the immediately preceding frame is transmitted in the present frame, and the predefined number of bits is in the approximate range of four to six. The speech parameter delta is used to update a memory table in the speech coding system when a frame erasure occurs.

5 Claims, 4 Drawing Sheets

FRAME ERASURE COMPENSATION TECHNIQUE

BACKGROUND OF THE INVENTION

1. Field of the Invention

This invention relates to speech coding arrangements for use in communication systems which are vulnerable to burst-like transmission errors.

2. Description of Prior Art

Many communication systems, such as cellular telephones and personal communications systems, rely on electromagnetic or wired communications links to convey information from one place to another. These communications links generally operate in less than ideal environments, with the result that fading, attenuation, multipath distortion, interference, and other adverse propagational effects may occur. In cases where information is represented digitally as a series of bits, such propagational effects may cause the loss or corruption of one or more bits. Oftentimes, the bits are organized into frames, such that a predetermined fixed number of bits comprises a frame. A frame erasure refers to the loss or substantial corruption of a set of bits communicated to a receiver.

To provide for an efficient utilization of a given bandwidth, communication systems directed to speech communications often use speech coding techniques. Many existing speech coding techniques are executed on a frame-by-frame basis, such that one frame is about 10–40 milliseconds in length. The speech coder extracts parameters that are representative of the speech signal. These parameters are then quantized and transmitted via the communications channel. State-of-the-art speech coding schemes generally include a parameter referred to as pitch delay, which is typically extracted once or more per frame. The pitch delay may be quantized using 7 bits to represent values in the range of 20–148. One well-known speech coding technique is code-excited linear prediction (CELP). In CELP, an adaptive codebook is used to associate specific parameter values with representations of corresponding speech excitation waveforms. The pitch delay is used to specify the repetition period of previously stored speech excitation waveforms.

If a frame of bits is lost, then the receiver has no bits to interpret during a given time interval. Under such circumstances, the receiver may produce a meaningless or distorted result. Although it is possible to replace the lost frame with a new frame estimated from a previous frame, this introduces inaccuracies which may not be tolerable or desirable in the context of many real-world applications. In the case of CELP speech coders, the use of an estimated value of pitch delay will modify the adaptive codebook in a manner that will result in the construction of a speech waveform having significant temporal misaligmnents. The temporal misalignment introduced into a given frame will then propagate to all future frames. The result is poorly-reconstructed, distorted, and/or unintelligible speech.

The problem of packet loss in packet-switched networks employing speech coding techniques is very similar to the problem of frame erasure in the context of wireless communication links. Due to packet loss, a speech decoder may either fail to receive a frame or receive a frame having a significant number of missing bits. In either case, the speech decoder is presented with essentially the same problem—the need to synthesize speech despite the loss of compressed speech information. Both frame erasure and packet loss concern a communications channel problem which causes the loss of transmitted bits. For purposes of this description, therefore, the term "frame erasure" may be deemed synonymous with packet loss.

SUMMARY OF THE INVENTION

In a speech coding system which encodes speech parameters into a plurality of frames, each frame having a predetermined number of bits, a predefined number of bits per frame are employed to transmit a speech parameter delta. The speech parameter delta specifies the amount by which the value of a given parameter has changed from a previous frame to the present frame. According to a preferred embodiment disclosed herein, a speech parameter delta representing change in pitch delay from the present frame to the immediately preceding frame is transmitted in the present frame, and the predefined number of bits is in the approximate range of four to six. The speech parameter delta is used to update a memory table in the speech coding system when a frame erasure occurs.

DETAILED DESCRIPTION OF THE PREFERRED EMBODIMENTS

Figure 1:
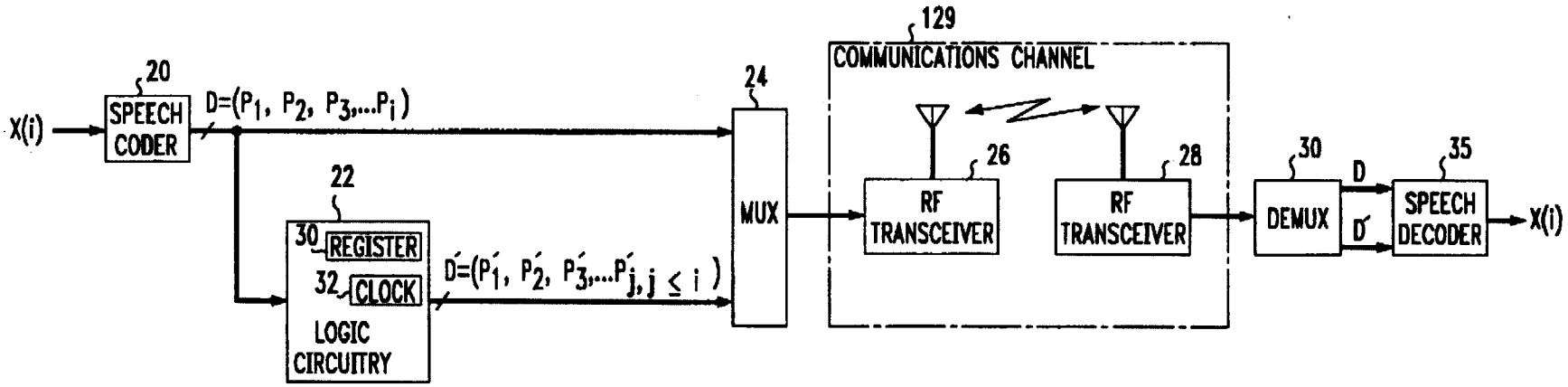
FIG. 1 is a hardware block diagram setting forth a speech coding system constructed in accordance with a first preferred embodiment disclosed herein.

Refer to FIG. 1, which is a hardware block diagram setting forth a speech coding system constructed in accordance with a first preferred embodiment to be described below. A speech signal, represented as X(i), is coupled to a conventional speech coder 20. Speech coder 20 may include elements such as an analog-to-digital converter, one or more frequency-selective filters, digital sampling circuitry, and/or a linear predictive coder (LPC). For example, speech coder 20 may comprise an LPC of the type described in U.S. Pat. No. 5,339,384, issued to Chen et al., and assigned to the assignee of the present patent application.

Irrespective of the specific internal structure of speech coder 20, this coder produces an output signal in the form of a digital bit stream. The digital bit stream, D, is a coded version of X(i), and, hence, includes "parameters" (denoted by $P_i$) which correspond to one or more characteristics of X(i). Typical parameters include the short term frequency of X(i), slope and pitch delay of X(i), etc. Since X(i) is a function which changes with time, the output signal of the speech decoder is periodically updated at regular time intervals. Therefore, during a first time interval $T_1$, the output signal comprises a set of values corresponding to parameters ($P_1$, $P_2$, $P_3$, . . . $P_i$), during time interval $T_1$. During time interval $T_2$, the value of parameters ($P_1$, $P_2$, $P_3$, . . . $P_i$) may change, taking on values differing from those of the first interval. Parameters collected during time interval $T_1$ are represented by a plurality of bits (denoted as $D_1$) comprising a first frame, and parameters collected during time interval $T_2$ are represented by a plurality of bits $D_2$ comprising a second frame. Therefore, $D_n$ refers to a set of bits representing all parameters collected during the nth time interval.

The output of speech coder 20 is coupled to a MUX 24 and to logic circuitry 22. MUX 24 is a conventional digital multiplexer device which, in the present context, combines the plurality of bits representing a given $D_n$ onto a single signal line. $D_n$ is multiplexed onto this signal line together with a series of bits denoted as $D_n'$, produced by logic circuitry 22 as described in greater detail below.

Logic circuitry 22 includes conventional logic elements such as logic gates, a clock 32, one or more registers 30, one or more latches, and/or various other logic devices. These logic elements may be configured to perform conventional authentic operations such as addition, multiplication, subtraction and division. Irrespective of the actual elements used to construct logic circuitry 22, this block is equipped to perform a logical operation on the output signal of speech coder 20 which is a function of the present value of a given parameter $P_i$ during time interval $T_n$ [i.e., $p_i(T_n)$] and a previous value of that same parameter $P_i$ during time interval $T_{n-m}$ [i.e., $p_i(T_{n-m})$], where m and n are integers. Therefore, logic circuitry 22 performs a function F on the output of speech coder 20 of the form $D_i'=F(D_i)=\{f(p_iT_n)+g(p_iT_{n-m})\}$. The output of logic circuitry 22, comprising a plurality of bits denoted as $D_j'$, is inputted to MUX 24, along with the plurality of bits denoted as $D_i$. Note that j is less than or equal to i, signifying that only a subset of the parameters are to be included in Dj. The actual values selected for i and j are determined by the available system bandwidth and the desired quality of the decoded speech in the absence of frame erasures.

The output of MUX 24, including a multiplexed version of $D_i$ and $D_j'$, is conveyed to another location over a communications channel 129. Although communications channel 129 could represent virtually any type of known communications channel, the techniques of the present invention are useful in the context of communications channels 129 which are vulnerable to momentary, intermittent data losses—i.e., frame erasures. In the example of FIG. 1, communications channel 129 consists of a pair of RF transceivers 26, 28. The output of MUX 24 is fed to RF transceiver 26, which modulates the MUX 24 output onto an RF carrier, and transmits the RF carrier to RF transceiver 28. RF transceiver 28 receives and demodulates this carrier. The demodulated output of RF transceiver 28 is processed by a demultiplexer, DEMUX 30, to retrieve $D_i$ and $D_j'$. The $D_i$ and $D_j'$ are then processed by speech decoder 35 to reconstruct the original speech signal X(i). Suitable devices for implementing speech decoder 35 are well-known to those skilled in the art. Speech decoder 35 is configured to decode speech which was coded by speech coder 20.

Figure 2:
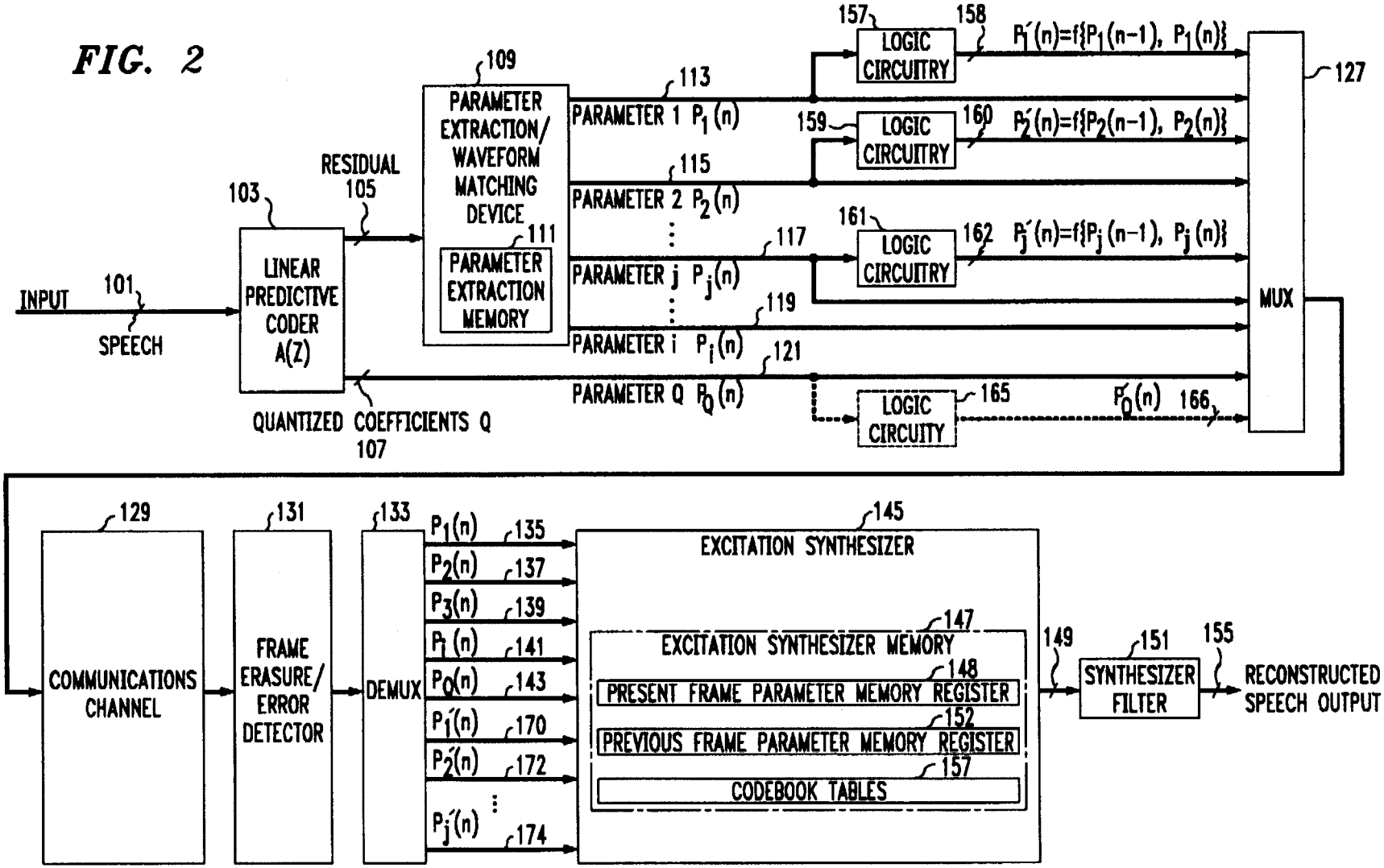
FIG. 2 is a hardware block diagram setting forth a speech coding system constructed in accordance with a second preferred embodiment disclosed herein.

FIG. 2 is a hardware block diagram setting forth a speech coding system constructed in accordance with a second preferred embodiment disclosed herein. A speech signal is fed to the input 101 of a linear predictive coder (LPC) 103. The speech signal may be conceptualized as consisting of periodic components combined with white noise not filtered by the vocal tract. Linear predictive coefficients (LPC) 103 are derived from the speech signal to produce a residual signal at signal line 105. The quantized LPC filter coefficients (Q) are placed on signal line 107. The digital encoding process which converts the speech to the residual domain effectively applies a filtering function A(z) to the input speech signal.

The selection and operation of suitable linear predictive decoders is a matter within the knowledge of those skilled in the art. For example, LPC 103 may be constructed in accordance with the LPC described in U.S. Pat. No. 5,341,456. The sequence of operations performed by LPCs are thoroughly described, for example, in CCITT International Standard G.728.

The residual signal on signal line 105 is inputted to a parameter extraction waveform matching device 109. Parameter extraction waveform matching device 109 is equipped to isolate and remove one or more parameters from the residual signal. These parameters may include characteristics of the residual signal waveform, such as amplitude, pitch delay, and others. Accordingly, the parameter extraction device may be implemented using conventional waveform-matching circuitry. Parameter extraction waveform matching device 109 includes a parameter extraction memory for storing the extracted values of one or more parameters.

In the example of FIG. 2, several parameters are extracted from the residual signal, including parameter 1 $P_1(n)$, parameter 2 $P_2(n)$, parameter j $P_j(n)$, parameter i $P_i(n)$, and parameter Q $P_q(n)$. Parameter 1 $P_1(n)$ is produced by parameter extraction waveform matching device 109 and placed on signal line 113; parameter 2 $P_2(n)$ is placed on signal line 115, parameter 3 $P_3(n)$ is placed on signal line 117, and ith parameter i $P_i(n)$ is placed on signal line 119. Note that parameter extraction waveform matching device 109 could extract a fewer number of parameters or a greater number of parameters than that shown in FIG. 2. Moreover, not all parameters need be obtained from the parameter extraction waveform matching device 109. Parameter Q $P_q(n)$ represents the quantized coefficients produced by LPC 103 and placed on signal line 121. Note that i is greater than or equal to j, indicating that a subset of parameters are to be applied to logic circuitry.

One or more of the extracted parameters is processed by logic circuitry 157, 159, 161, 165. Each logic circuitry 157, 159, 161, 165 element produces an output which is a function of the present value of a given parameter and/or the immediately preceding value of this parameter. With respect to parameter 1 $P_1(n)$, the output of this function, denoted as $P'_1(n)$, may be expressed as $f\{P_1(n-1), P_1(n)\}$, where n is an integer representing time and/or a running clock pulse count. The function applied to parameter 2 $P_2(n)$ may, but need not be, the same function as that applied to parameter 1 $P_1(n)$. Therefore, logic circuitry 157 may, but need not be, identical to logic circuitry 159. Each logic circuitry 157, 159, 161, 163, 165 element includes some combination of conventional logic gates, registers, latches, multipliers and/or adders configured in a manner so as to perform the desired function (i.e., function f in the case of logic circuitry 157). Parameters $P'_1(n)$, $P'_2(n)$, . . . $P'_j(n)$ are termed "processed parameters", and parameters $P_1(n)$, $P_2(n)$, . . . $P_i(m)$ are termed "original parameters".

Logic circuitry 157 places processed parameter $P'_1(n)$ on signal line 158, logic circuitry 159 places processed parameter $P'_2(n)$ on signal line 160, logic circuitry 161 places processed parameter $P'_j(n)$ on signal line 162, and logic circuitry 165 places processed parameter $P'_q(n)$ on signal line 166.

All original and processed parameters are multiplexed together using a conventional multiplexer device, MUX 127. The multiplexed signal is sent out over a conventional communications channel 129 which includes an electromagnetic communications link. Communications channel 129 may be implemented using the devices previously described in conjunction with FIG. 1, and may include RF transceivers in the form of a cellular base station and a cellular telephone device. The system shown in FIG. 2 is suitable for use in conjunction with digitally-modulated base stations and telephones constructed in accordance with CDMA, TDMA, and/or other digital modulation standards.

The communications channel 129 conveys the output of MUX 127 to a frame erasure/error detector 131. The frame erasure/error detector 131 is equipped to detect bit errors and/or erased frames. Such errors and erasures typically arise in the context of practical, real-world communications channels 129 which employ electromagnetic communications links in less-than-ideal operational environments. Conventional circuitry may be employed for frame erasure/error detector 131. Frame erasures can be detected by examining the demodulated bitstream at the output of the demodulator or from a decision feedback from the demodulation process.

Frame erasure/error detector 131 is coupled to a DEMUX 133. Frame erasure/error detector 131 conveys the demodulated bitstream retrieved from communications channel 129 to the DEMUX 133, along with an indication as to whether or not a frame erasure has occurred. DEMUX 133 processes the demodulated bit stream to retrieve parameters $P_1(n)$ 135, $P_2(n)$ 137, $P_3(n)$ 139, . . . $P_i(n)$ 141, $P_q(n)$ 143, $P_i(n)$ 170, $P'_2(n)$ 172, and $P'_j(n)$ 174. In addition, DEMUX 133 may be employed to relay the presence or absence of a frame erasure, as determined by frame erasure/error detector 131, to an excitation synthesizer 145. Alternatively, a signal line may be provided, coupling frame erasure/error detector 131 directly to excitation synthesizer 145, for the purpose of conveying the existence or non-existence of a frame erasure to the excitation synthesizer 145.

The physical structure of excitation synthesizer 145 is a matter well-known to those skilled in the art. Functionally, excitation synthesizer 145 examines a plurality of input parameters $P_1(n)$ 135, $P_2(n)$ 137, $P_3(n)$ 139, . . . $P_i(n)$ 141, $P_q(n)$ 143 and fetches one or more entries from code book tables 157 stored in excitation synthesizer memory 147 to locate a table entry that is associated with, or that most closely corresponds with, the specific values of input parameters inputted into the excitation synthesizer. The table entries in the codebook tables 157 are updated and augmented after parameters for each new frame are received. New and/or amended table entries are calculated by excitation synthesizer 145 as the synthesizer filter 151 produces reconstructed speech output. These calculations are mathematical functions based upon the values of a given set of parameters, the values retrieved from the codebook tables, and the resulting output signal at reconstructed speech output 155. The use of accurate codebook table entries 157 results in the generation of reconstructed speech for future frames which most closely approximates the original speech. The reconstructed speech is produced at reconstructed speech output 155. If incorrect or garbled parameters are received at excitation synthesizer 145, incorrect table parameters will be calculated and placed into the codebook tables 157. As discussed previously, these parameters can be garbled and/or corrupted due to the occurrence of a frame erasure. These frame erasures will degrade the integrity of the codebook tables 157. A codebook table 157 having incorrect table entry values will cause the generation of distorted, garbled reconstructed speech output 155 in subsequent frames.

Specific examples of suitable excitation synthesizers for excitation synthesizers are described in the Pan-European GSM Cellular System Standard, the North American IS-54 TDMA Digital Cellular System Standard, and the IS-95 CDMA Digital Cellular Communications System standard.

Although the embodiments described herein are applicable to virtually any speech coding technique, the operation of an illustrative excitation synthesizer 145 is described briefly for purposes of illustration. A plurality of input parameters $P_1(n)$ 135, $P_2(n)$ 137, $P_3(n)$ 139, . . . $P_i(n)$ 141, $P_q(n)$ 143 represent a plurality of codebook indices. These codebook indices are multiplexed together at the output of MUX 127 and sent out over communications channel 129. Each index specifies an excitation vector stored in excitation synthesizer memory 147. Excitation synthesizer memory 147 includes a plurality of tables which are referred to as an "adaptive codebook", a "fixed codebook" and a "gain codebook". The organizational topology of these codebooks is described in GSM and IS54.

The codebook indices are used to index the codebooks. The values retrieved from the codebooks, taken together, comprise an extracted excitation code vector. The extracted code vector is that which was determined by the encoder to be the best match with the original speech signal. Each extracted code vector may be scaled and/or normalized using conventional gain amplification circuitry.

Excitation synthesizer memory 147 is equipped with registers, referred to hereinafter as the present frame parameter memory register 148, for storing all input parameters $P_1(n)$ 135, $P_2(n)$ 137, $P_3(n)$ 139, . . . $P_i(n)$ 141, $P_q(n)$ 143, $P'_1(n)$ 170, $P'_2(n)$ 172, $P'_j(n)$ 174, corresponding to a given frame n. A previous frame parameter memory register 152 is loaded with parameters for frame n−1, including parameters $P_1(n-1)$, $P_2(n-1)$, $P_3(n-1)$, . . . $P_i(n-1)$, $P_q(n-1)$, $P'_1(n-1)$, $P'_2(n-1)$, . . . $P'_j(n-1)$. Although, in the present example, the previous frame parameter memory register 152 includes parameters for the immediately preceding frame, this is done for illustrative purposes, the only requirement being that this register include values for a frame (n−m) that precedes frame n.

If no frame erasure has been detected by frame erasure/error detector 131, then the extracted code vectors are outputted by excitation synthesizer 145 on signal line 149. If a frame erasure is detected by frame erasure/error detector 131, then the excitation synthesizer 145 can be used to compensate for the missing frame. In the presence of frame erasures, the excitation synthesizer 145 will not receive reliable values of input parameters $P_1(n)$ 135, $P_2(n)$ 137, $P_3(n)$ 139, . . . $P_i(n)$ 141, $P_q(n)$ 143, for the case where frame n is erased. Under these circumstances, the excitation synthesizer is presented with insufficient information to enable the retrieval of code vectors from excitation synthesizer memory 147. If frame n had not been erased, these code vectors would be retrieved from excitation synthesizer memory 147 based upon the parameter values stored in register mem(n) of excitation synthesizer memory. In this case, since the present frame parameter memory register 148 is not loaded with accurate parameters corresponding to frame n, the excitation synthesizer must generate a substitute excitation signal for use in synthesizing a speech signal. This substitute excitation signal should be produced in a manner so as to accurately and efficiently compensate for the erased frame.

According to a preferred embodiment disclosed herein, an enhanced frame erasure compensation technique is provided which represents a substantial improvement over the prior art schemes discussed above in the Background of the Invention. This technique involves synthesizing the missing frame by utilizing redundant information which is transmitted as an additional parameter in a frame subsequent to the missing frame. However, unlike the remaining parameters in the frame which all specify characteristics corresponding to a given frame n, this additional parameter specifies one or more characteristics corresponding to a preceding frame n−m. According to a preferred embodiment disclosed herein, m=1, and this additional parameter includes information about the immediately preceding frame, such as the pitch delay of the preceding frame. This additional parameter is then used to synthesize or reconstruct the erased frame. In the example of FIG. 2, such a synthesized frame is forwarded to signal line 149 in the form of a synthesized code vector. Further details concerning this enhanced compensation technique will be described hereinafter with reference to FIG. 3.

Returning now to FIG. 2, the code vector on signal line 149 is fed to a synthesizer filter 151. This synthesizer filter 151 generates decoded speech on signal line 155 from input code vectors on signal line 149.

Figure 3:
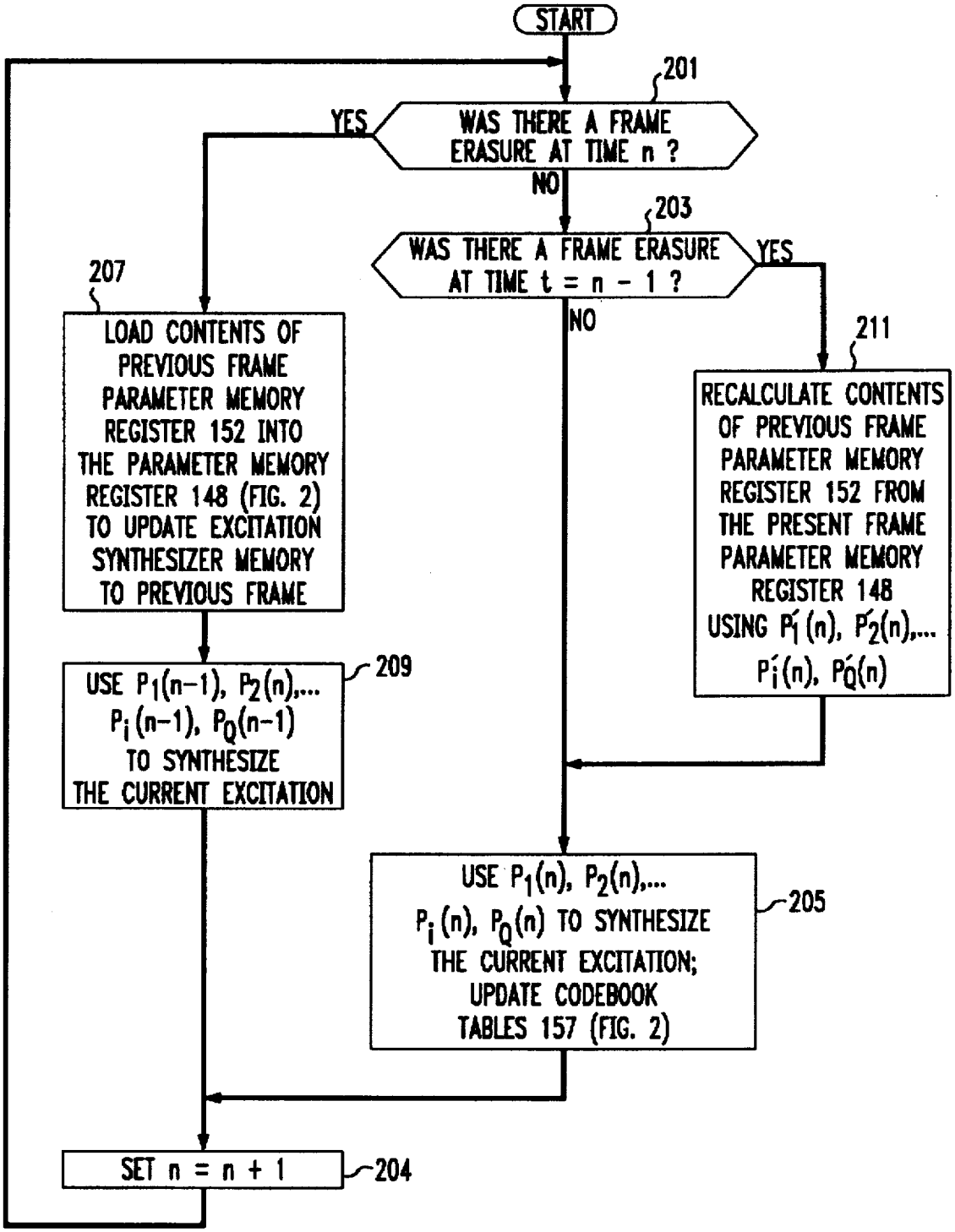
FIG. 3 is a software flowchart setting forth a speech coding method performed according to a preferred embodiment disclosed herein.

FIG. 3 is a software flowchart setting forth a method of speech coding according to a preferred embodiment disclosed herein. The program commences at block 201, where a test is performed to ascertain whether or not a frame erasure occurred at time n. If so, program control progresses to block 207 where the contents of the previous frame parameter memory register 152 are loaded into the present frame parameter memory register 148. Prior to performing block 207, the present frame parameter memory register 148 was loaded with inaccurate values because these values correspond to the erased frame. Parameter values for the immediately preceding frame are obtained at block 207 from the previous frame parameter memory register 152. Note that there is no absolute requirement to employ values from the immediately preceding frame (n−1). In lieu of using frame n−1, values from any previous frame n−m may be employed, such that the previous frame parameter memory register 152 is used to store values for frame n−m. However, in the context of the present example, it is preferred to store values for the immediately preceding frame in the previous frame parameter memory register 152. After block 207, the present frame parameter memory register 148 is loaded with parameters from frame (n−1 ).

From block 207, the program progresses to block 209, where the input parameters $P_1(n-1)$, $P_2(n)$, . . . $P_i(n-1)$, $P_Q(n-1)$ (as loaded into the present frame parameter memory register 148 at block 207) are used to synthesize the current excitation. The value of n is incremented at block 204 by setting n=n+1, and the program loops back to block 201, where the next frame will be processed.

The negative branch from block 201 leads to block 203 where the program performs a test to ascertain whether or not there was a frame erasure at time t=n−1. If not, the program advances to block 205 where $P_1(n)$, $P_2(n)$, . . . $P_i(n)$, and $P_q(n)$ are used (i.e., by excitation synthesizer 145 (FIG. 2)) to synthesize the current excitation. Next, n is incremented by setting n=n+1 at block 204, and the program loops back to block 201.

The affirmative branch from block 203 leads to block 211 where values for parameters corresponding to an erased frame n−1 and now stored in the previous frame parameter memory register 152 are calculated from values stored in the present frame parameter memory register 148 using parameters $P'_1(n)$, $P'_2(n)$, $P'_3(n)$, . . . $P'_j(n)$, and $P'_q(n)$, where $P'_1(n)$, $P'_2(n)$, $P'_3(n)$, . . . $P'_j(n)$, and $P'_q(n)$, represent the $D'_j$ described above in connection with FIG. 1. This $D'_j$ employs a redundant parameter sent out in frame n to calculate one or more parameter values corresponding to the erased frame n−1. These calculated parameters are then used by excitation synthesizer 145 to update codebook tables 157 at block 205. Also at block 205, excitation synthesizer 145 synthesizes the current excitation on signal line 149 using parameters $P_1(n)$, $P_2(n)$, $P_3(n)$, . . . $P_i(n)$, and $P_q(n)$. n is incremented by setting n=n+1 at block 204, and the program loops back to block 201.

Figure 4A:
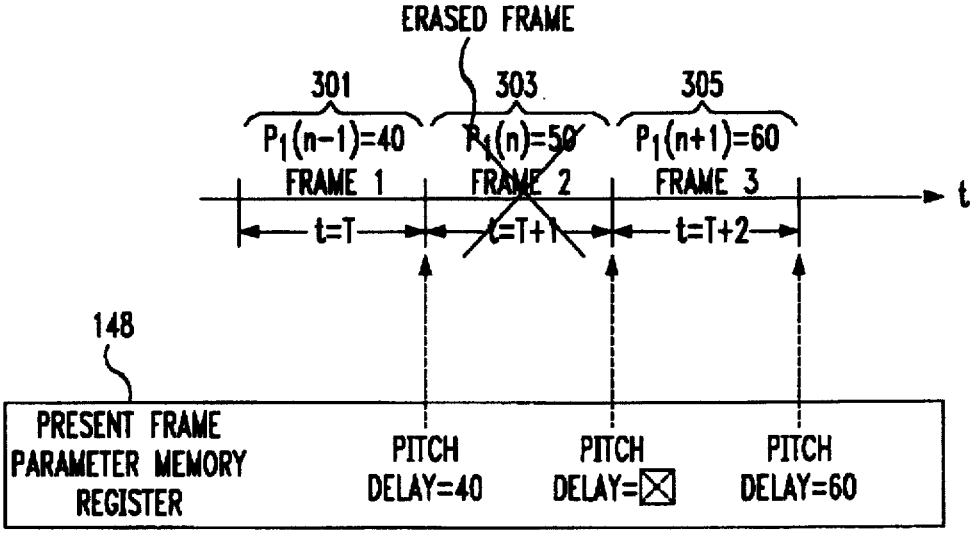
FIG. 4A PRIOR ART
FIGS. 4A and 4B set forth illustrative data structure diagrams for use in conjunction with the systems and methods described in FIGS. 1–3.
Figure 4B:
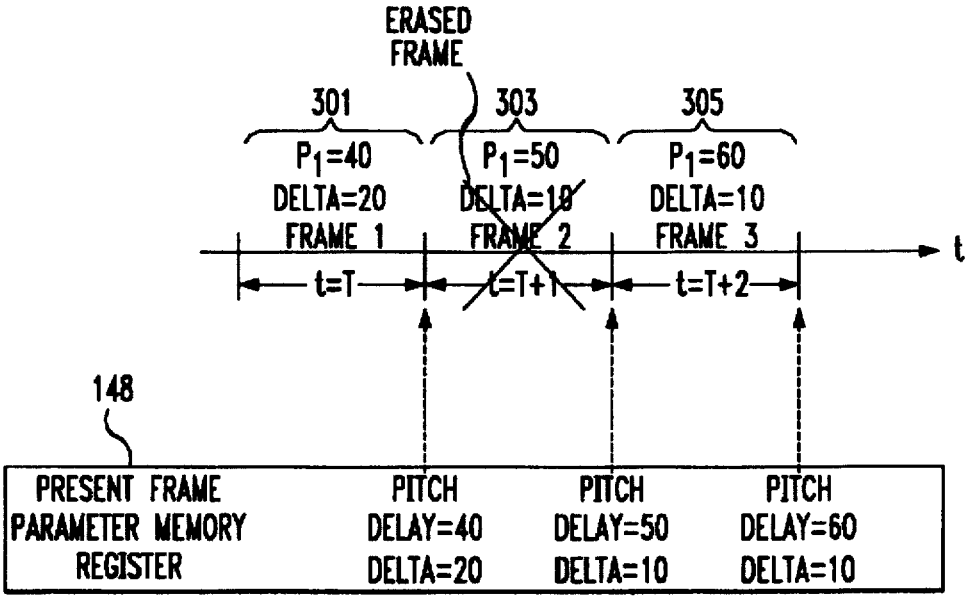

FIG. 4A shows the contents of the present frame parameter memory register 148 pursuant to prior art techniques, whereas FIG. 4B shows the contents of the present frame parameter memory register 148 in accordance with a preferred embodiment disclosed herein. Referring now to FIG. 4A, the contents of the present frame parameter memory register 148 during three different frames 301, 303, and 305 are shown. Frame 301 was sent at time t=T, and corresponds to frame n−1. Frame 303 was sent out at time t=T+1, and corresponds to frame n. It is assumed that, for purposes of the present example, frame 303 has been erased. Frame 305 was sent out at time t=T+2, and corresponds to frame n+1.

Assume that the present frame parameter memory register 148 is employed to store a parameter corresponding to pitch delay. During frame 301, the present frame parameter memory register 148 is loaded with a pitch delay parameter of 40. This pitch delay is now used to calculate a new codebook table entry for the table 157 (FIG. 2). During frame 303, no pitch delay parameter was received because this frame was erased. However, the previous value of pitch delay, 40, is now stored in previous frame parameter memory register 152. Although this previous value of 40 is probably not the correct value of pitch delay for the present frame, this value is used to calculate a new codebook table entry for the codebook table 157. Note that the codebook table 157 now contains an error. At frame 305, a pitch delay of 60 is received. The delay is stored in the present frame parameter memory register 148, and is used to calculate a new codebook table entry for the codebook table 157. Therefore, this prior art method results in the generation of inaccurate codebook table 157 entries every time a frame erasure occurs.

Refer now to FIG. 4B which sets forth illustrative data structure diagrams for use in conjunction with the systems and methods described in FIGS. 1–3. As in the case of FIG. 4A, the contents of the present frame parameter memory register 148 during three different frames 301, 303, and 305 is shown. Frame 301 was sent at time t=T, and corresponds to frame n−1. Frame 303 was sent out at time t=T+1, and corresponds to frame n. It is assumed that, for purposes of the present example, frame 303 has been erased. Frame 305 was sent out at time t=T+2, and corresponds to frame n+1.

The present frame parameter memory register 148 is employed to store a parameter corresponding to pitch delay, as well as a new parameter, delta, corresponding to the change in pitch delay between the present frame and a previous frame. Unlike the prior art system of FIG. 4A, this additional, redundant parameter is sent out in the previous frame that has been erased. In the present example, delta specifies how much the pitch delay has changed between the present frame, n, and the immediately preceding frame, n−1. This delta parameter is sent out along with the rest of the parameters the present frame, such as the pitch delay of the present frame n. For normal speech, it is expected that the pitch delay will not vary excessively from frame to frame. Therefore, delta will generally exhibit a smaller range of values relative to the variances in actual pitch delay. In practice, the delta parameter can be coded using a small number of bits, such as a five-bit, a six-bit, or a seven-bit value.

During frame 301, a pitch delay parameter of 40 is received, along with a delta parameter of 20. Therefore, one may deduce that the pitch delay parameter for the frame immediately preceding frame 301 was {(pitch delay of present frame)–(delta)}, which is {40–20}, or 20. In this case, however, assume that the frame immediately preceding frame 301 has not been erased. It is not necessary to use the pitch delta parameter of frame 301 to calculate the pitch delay of the frame preceding frame 301, so, in the present situation, delta represents redundant information. For frame 301, the present frame parameter memory register 148 is loaded with a pitch delay of 40. This pitch delay is now used to calculate a new codebook table entry for the codebook table 157 stored in excitation synthesizer memory 147 (FIG. 2).

During frame 303, no pitch delay was received because this frame was erased. Therefore, the present frame parameter memory register 148 now contains an incorrect value of pitch delay. Since the previous pitch delay of 40 is not the correct value of pitch delay for this frame 303, this value is not used to calculate a new codebook table entry for the codebook table 157 (FIG. 2). Note that the codebook table has not been corrupted with an error.

At frame 305, a pitch delay of 60 is received, along with a delta of 10. Delta is used to calculate the value of pitch delay for the immediately preceding frame, frame 303. This calculation is performed by subtracting delta from the pitch delay of the present frame, frame 305, to calculate the value of pitch delay for the erased frame, frame 303. Since the pitch delay of the 'present' frame, frame 305, is 60, and delta is 10, the pitch delay of the preceding frame, frame 303, was {60–10} or 50. After the pitch delay of the erased frame, frame 303, is calculated from the pitch delta of the immediately succeeding frame, frame 305, this calculated value (i.e., 50 in this example) is used to calculate a new codebook table entry for the codebook table 157 (FIG. 2). Note that the incorrect value of pitch delay from the previous frame (40, in the present example) was never used to calculate a codebook table entry. Therefore, this method results in the generation of accurate codebook table entries despite the occurrence of a frame erasure.

The delta parameter enables the pitch delay of the immediately preceding erased frame to be calculated exactly (not estimated or approximated). Although the disclosed example employs a delta which stores the difference in pitch delay between a given frame and the frame immediately preceding this given frame, it is also possible to use a delta which stores the difference in pitch delay between a given frame and a frame which precedes this given frame by any known number of frames. For example, delta may be equipped to store the difference in pitch delay between a given frame, n, and the second-to-most-recently-preceding frame, n–2. Such a delta is useful in environments where consecutive frames are vulnerable to erasures.

The invention claimed is:

1. In a speech coding system for coding speech into a plurality of sequential frames and having a memory table associating each of a plurality of coded speech representations with a corresponding parameter set consisting of a plurality of speech parameters, an error compensation method comprising the following steps:

(a) incorporating into each sequential frame a delta parameter specifying the amount by which one of the plurality of speech parameters changes from a given sequential frame to a frame preceding the given sequential frame by a predetermined number of frames; and (b) upon the occurrence of a frame erasure, updating the memory table based upon the delta parameter of the frame succeeding the erased frame by the predetermined number of frames.

2. In a speech coding system for coding speech into a plurality of sequential frames and having a memory table associating each of a plurality of coded speech representations with a corresponding parameter set consisting of a plurality of speech parameters, an error compensation method comprising the following steps:

(a) incorporating into each sequential frame a delta parameter specifying the amount by which one of the plurality of speech parameters changes from a given sequential frame to the frame immediately preceding the given sequential frame; and (b) upon the occurrence of a frame erasure, updating the memory table based upon the delta parameter of the frame immediately succeeding the erased frame.

3. A speech coding method including the following steps:

(a) representing speech using a plurality of sequential frames including a present frame and a previous frame, each frame having a predetermined number of bits for representing each of a plurality of speech parameters; the plurality of speech parameters comprising a speech parameter set;

(b) including a delta parameter in the present frame indicative of the change in one of the plurality of speech parameters from the present frame to the previous frame;

(c) storing a code table in memory associating each of a plurality of speech parameter sets with corresponding digitally coded representations of speech; the code table being updated subsequent to the receipt of each new parameter set;

(d) using the delta parameter to update the code table subsequent to the occurrence of a frame erasure.

4. A speech coding method as set forth in claim 3 wherein the previous frame immediately precedes the present frame.

5. A speech coding method as set forth in claim 3 wherein, in the absence of an erased frame, the code table is updated upon receipt of the present frame, and, in the presence of an erased frame, the code table is updated upon receipt of the frame immediately succeeding the erased frame.

* * * * *